US010443141B2

(12) United States Patent
Tani et al.

(10) Patent No.: US 10,443,141 B2
(45) Date of Patent: Oct. 15, 2019

(54) STEEL SHEET FOR CONTAINERS, AND METHOD FOR PRODUCING STEEL SHEET FOR CONTAINERS

(71) Applicant: NIPPON STEEL & SUMITOMO METAL CORPORATION, Tokyo (JP)

(72) Inventors: Yoshiaki Tani, Kitakyushu (JP); Shigeru Hirano, Kitakyushu (JP); Akira Tachiki, Kitakyushu (JP); Morio Yanagihara, Kitakyushu (JP); Makoto Kawabata, Kitakyushu (JP); Hirokazu Yokoya, Onga-gun (JP)

(73) Assignee: NIPPON STEEL CORPORATION, Tokyo (JP)

( * ) Notice: Subject to any disclaimer, the term of this patent is extended or adjusted under 35 U.S.C. 154(b) by 340 days.

(21) Appl. No.: 14/891,945

(22) PCT Filed: May 21, 2014

(86) PCT No.: PCT/JP2014/063478
§ 371 (c)(1),
(2) Date: Nov. 17, 2015

(87) PCT Pub. No.: WO2014/189081
PCT Pub. Date: Nov. 27, 2014

(65) Prior Publication Data

US 2016/0122891 A1 May 5, 2016

(30) Foreign Application Priority Data

May 21, 2013 (JP) ..... 2013-107304

(51) Int. Cl.
*C25D 5/12* (2006.01)
*C25D 5/48* (2006.01)
(Continued)

(52) U.S. Cl.
CPC ..... *C25D 5/12* (2013.01); *C23C 2/08* (2013.01); *C23C 28/321* (2013.01);
(Continued)

(58) Field of Classification Search
None
See application file for complete search history.

(56) References Cited

U.S. PATENT DOCUMENTS

2010/0119867 A1* 5/2010 Date ..... C23C 22/58 428/633
2010/0310898 A1 12/2010 Date
(Continued)

FOREIGN PATENT DOCUMENTS

CN 101952479 A 1/2011
CN 102959136 A 3/2013
(Continued)

OTHER PUBLICATIONS

English machine translation of Nishida (JP 2009-249691), EPO, accessed Oct. 5, 2017.*
(Continued)

*Primary Examiner* — Humera N Sheikh
*Assistant Examiner* — Xiaobei Wang
(74) *Attorney, Agent, or Firm* — Birch, Stewart, Kolasch & Birch, LLP

(57) ABSTRACT

A steel sheet for containers includes a steel sheet, an underlying Ni layer formed by performing a Ni coating or a Fe—Ni alloy coating containing Ni in an amount of 5 mg/m$^2$ to 150 mg/m$^2$ in terms of an amount of metal Ni on at least one surface of the steel sheet, a Sn coated layer formed by performing a Sn coating containing Sn in an amount of 300 mg/m$^2$ to 3,000 mg/m$^2$ in terms of an amount of metal Sn on the underlying Ni layer and including an island-shaped Sn formed by alloying the Sn coating and at least a part of the
(Continued)

underlying Ni layer by a reflow treatment, an oxide layer formed on the Sn coated layer and containing tin oxide, and a chemical treatment layer formed on the oxide layer and at least contains Zr in an amount of 1 $mg/m^2$ to 500 $mg/m^2$ in terms of an amount of metal Zr and phosphate acid in an amount of 0.1 $mg/m^2$ to 100 $mg/m^2$ in terms of an amount of P, in which the oxide layer contains tin oxide in such an amount that an amount of electricity required for reduction of the oxide layer is 0.3 $mC/cm^2$ to 10 $mC/cm^2$.

3 Claims, 6 Drawing Sheets

(51) Int. Cl.

| | |
|---|---|
| ***C25D 9/08*** | (2006.01) |
| ***C23C 2/08*** | (2006.01) |
| ***C25D 3/12*** | (2006.01) |
| ***C25D 3/30*** | (2006.01) |
| ***C25D 3/54*** | (2006.01) |
| ***C25D 5/36*** | (2006.01) |
| ***C25D 7/00*** | (2006.01) |
| ***C25D 5/50*** | (2006.01) |
| ***C23C 28/00*** | (2006.01) |

(52) U.S. Cl.
CPC ..... *C23C 28/322* (2013.01); *C23C 28/34* (2013.01); *C23C 28/345* (2013.01); *C25D 3/12* (2013.01); *C25D 3/30* (2013.01); *C25D 3/54* (2013.01); *C25D 5/36* (2013.01); *C25D 5/48* (2013.01); *C25D 5/505* (2013.01); *C25D 7/00* (2013.01); *C25D 9/08* (2013.01)

(56) References Cited

U.S. PATENT DOCUMENTS

| | | | | |
|---|---|---|---|---|
| 2012/0183753 | A1 | 7/2012 | Hirano et al. | |
| 2013/0034745 | A1* | 2/2013 | Tachiki ..... | B32B 15/015 428/679 |
| 2013/0089751 | A1 | 4/2013 | Hirano et al. | |
| 2013/0209827 | A1 | 8/2013 | Suzuki et al. | |
| 2013/0209829 | A1 | 8/2013 | Suzuki et al. | |
| 2013/0216714 | A1 | 8/2013 | Suzuki et al. | |

FOREIGN PATENT DOCUMENTS

| | | | |
|---|---|---|---|
| CN | 103097582 | A | 5/2013 |
| EP | 2589685 | A1 | 5/2013 |
| JP | 2007-284789 | A | 11/2007 |
| JP | 2009-249691 | * | 10/2009 |
| JP | 2009-249691 | A | 10/2009 |
| JP | 2010-261068 | A | 11/2010 |
| JP | 2012-62521 | A | 3/2012 |
| WO | WO 2011/118588 | A1 | 9/2011 |
| WO | WO 2012/002360 | A1 | 1/2012 |
| WO | WO 2012/036204 | A1 | 3/2012 |

OTHER PUBLICATIONS

International Search Report, dated Aug. 12, 2014, issued in PCT/JP2014/063478.
Written Opinion of the International Searching Authority, dated Aug. 12, 2014, issued in PCT/JP2014/063478.
Korean Office Action and Search Report, dated Sep. 20, 2016, for Korean Application No. 10-2015-7032927, with an English translation thereof.
Chinese Office Action and Search Report, dated Dec. 2, 2016, for counterpart Chinese Application No. 201480028919.X, with an English translation thereof.
Extended European Search Report, dated Dec. 15, 2016, for counterpart European Application No. 14800433.6.

* cited by examiner

STEEL SHEET FOR CONTAINERS, AND METHOD FOR PRODUCING STEEL SHEET FOR CONTAINERS

TECHNICAL FIELD OF THE INVENTION

The present invention relates to a steel sheet for containers and a method for producing a steel sheet for containers.

Priority is claimed on Japanese Patent Application No. 2013-107304, filed on May 21, 2013, the content of which is incorporated herein by reference.

RELATED ART

As containers for beverages and foods, metal containers that are made into cans from steel sheets such as a nickel (Ni)-coated steel sheet, a tin (Sn)-coated steel sheet, or a tin alloy-based steel sheet have been widely used. In many cases, such steel sheets for metal containers are subjected to a rustproofing treatment using chromate such as hexavalent chromate or the like in order to ensure adhesion between the steel sheet and the coating or between the steel sheet and the film and to ensure corrosion resistance. However, since hexavalent chromate used for the rustproofing treatment using chromate is environmentally harmful, instead of the rustproofing treatment using chromate that hitherto has been performed on steel sheets for containers, a treatment using a chemical treatment film such as a zirconium (Zr)-phosphorus (P) film or the like has been developed (for example, refer to Patent Document 1 below).

PRIOR ART DOCUMENT

Patent Document

[Patent Document 1] Japanese Unexamined Patent Application, First Publication No. 2007-284789

DISCLOSURE OF THE INVENTION

Problems to be Solved by the Invention

When a metal container formed by using the above-described steel sheet for containers is used for foods such as meat and vegetables including an amino acid containing sulfur (S), the foods are heated at the time of sterilization treatment. At this time, sulfur is bonded with tin, iron (Fe) and the like and the steel sheet becomes black. This phenomenon is called sulfide stain and due to this sulfide stain, a problem of the design of the inner surface of the metal container becoming deteriorated arises.

In order to deal with such sulfide stain, in the related art, by using chromate for forming a dense film even with a small amount of film, sulfide stain resistance of the metal container has been achieved. However, in the case in which a chemical treatment film such as a zirconium-phosphorus film is used instead of using chromate, when the amount of film is small, a large number of film defects are generated. Therefore, in order to exhibit excellent corrosion resistance, the amount of film cannot be reduced and cost reduction is difficult.

Therefore, there has been a demand for a technique capable of achieving both sulfide stain resistance and cost reduction using a chemical treatment film.

The present invention has been made in consideration of the above-described problems and an object thereof is to provide a steel sheet for containers that is capable of achieving sulfide stain resistance and cost reduction using a chemical treatment film and a method for producing a steel sheet for containers.

Means for Solving the Problem

In order to solve the above-described problems, as a result of an intensive investigation conducted by the inventors, it has been found that all of the above-described problems can be solved by forming an oxide layer including tin oxide (SnOx) between a chemical treatment film and a Sn coated layer. The gist thereof is as follows.

(1) According to an aspect of the present invention, a steel sheet for containers is provided, including: a steel sheet; an underlying Ni layer formed by performing a Ni coating or a Fe—Ni alloy coating containing Ni in an amount of 5 mg/m$^2$ to 150 mg/m$^2$ in terms of an amount of metal Ni on at least one surface of the steel sheet; a Sn coated layer formed by performing Sn coating containing Sn in an amount of 300 mg/m$^2$ to 3,000 mg/m$^2$ in terms of an amount of metal Sn on the underlying Ni layer and including an island-shaped Sn formed by alloying the Sn coating and at least a part of the underlying Ni layer by a reflow treatment; an oxide layer formed on the Sn coated layer and containing tin oxide; and a chemical treatment layer formed on the oxide layer and containing Zr in an amount of 1 m g/m$^2$ to 500 mg/m$^2$ in terms of an amount of metal Zr and phosphate acid in an amount of 0.1 mg/m$^2$ to 100 mg/m$^2$ in terms of an amount of P, wherein the oxide layer contains tin oxide in such an amount that an amount of electricity required for reduction of the oxide layer is 0.3 mC/cm$^2$ to 10 mC/cm$^2$.

(2) In the steel sheet for containers according (1), the oxide layer may contain tin oxide in such an amount that an amount of electricity required for reduction of the oxide layer is 5.5 mC/cm$^2$ to 10 mC/cm$^2$.

(3) In the steel sheet for containers according (1) or (2), after a lacquer is applied to the surface of the steel sheet for containers and the steel sheet is baked to form a lacquer, the steel sheet for containers in which the lacquer is formed may be placed and fixed onto an opening of a heat-resistant bottle in which a 0.6% by mass L-cysteine solution, which is boiled for 1 hour, is stored, the heat-resistant bottle may be capped with a lid, a heat treatment is performed at 110° C. for 30 minutes in a state of the lid being upside down, and then when an appearance of a contact portion of the steel sheet for containers in which the lacquer is formed with the heat-resistant bottle is observed, a stain may not occur in 50% or more of an area of the contact portion.

(4) According to another aspect of the invention, there is a method for producing a steel sheet for containers including: forming an underlying Ni layer containing Ni in an amount of 5 mg/m$^2$ to 150 mg/m$^2$ in terms of an amount of metal Ni by performing a Ni coating or a Fe—Ni alloy coating on at least one surface of a steel sheet; performing a Sn coating containing Sn in an amount of 300 mg/m$^2$ to 3,000 mg/m$^2$ in terms of an amount of metal Sn on the underlying Ni layer; forming an oxide layer containing tin oxide by oxidizing a surface of a Sn coated layer, while forming the Sn coated layer including an island-shaped Sn formed by alloying the Sn coating and at least a part of the underlying Ni layer by performing a reflow treatment at a temperature of 200° C. or higher and 300° C. or lower for 0.2 seconds to 20 seconds; and forming a chemical treatment layer on the oxide layer by performing an electrolysis treatment at a current density of 1.0 A/dm$^2$ or more and 100 A/dm$^2$ or less for an electrolysis treatment time of 0.2 seconds or longer and 150 seconds or shorter in a chemical treatment solution including 10 ppm or more and 10,000 ppm or less of Zr ions, 10 ppm or more and 10,000 ppm or less of fluoride ions, 10 ppm or more and 3,000 ppm or less of phosphate ions, and 100 ppm or more and 30,000 ppm or less of nitrate ions and/or sulfate ions and having a temperature of 5° C. or higher and lower than 90° C.

Effects of the Invention

According to the above aspects, it is possible to achieve sulfide stain resistance and cost reduction using a chemical treatment layer by forming an oxide layer between the chemical treatment layer and the Sn coated layer.

EMBODIMENT OF THE INVENTION

Figure 1A:
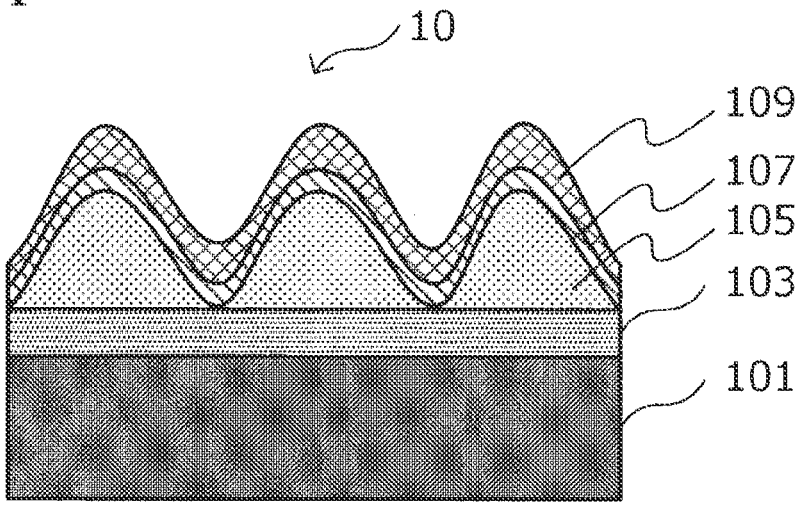
FIG. 1A is an explanatory view schematically showing a steel sheet for containers according to an embodiment of the present invention.

Hereinafter, a preferred embodiment of the present invention will be described with reference to the attached drawings. In addition, in the specification and drawings, the same reference numerals will be given to components having substantially the same function and configuration, and redundant descriptions will be omitted by imparting the same reference numerals.

<Regarding Configuration of Steel Sheet for Containers>

Figure 1B:
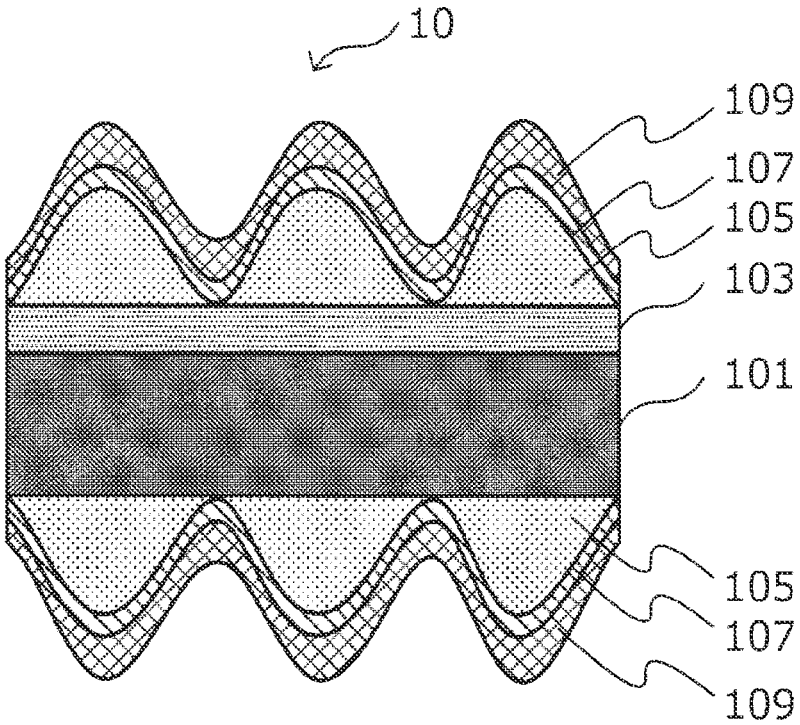
FIG. 1B is an explanatory view schematically showing the steel sheet for containers according to the present embodiment.

First, a configuration of a steel sheet for containers according to an embodiment of the present invention will be described in detail with reference to FIGS. 1A and 1B. FIGS. 1A and 1B are explanatory views schematically showing a configuration of a steel sheet for containers according to the present embodiment when viewed from the side of the steel sheet.

As shown in FIGS. 1A and 1B, a steel sheet for containers 10 according to the present embodiment includes a steel sheet 101, an underlying Ni layer 103, a Sn coated layer 105, an oxide layer 107, and a chemical treatment layer 109. The underlying Ni layer 103, the Sn coated layer 105, the oxide layer 107 and the chemical treatment layer 109 may be formed on only one surface of the steel sheet 101, as shown in FIG. 1A, or may be formed on two opposite surfaces of the steel sheet 101, as shown in FIG. 1B.

[Regarding Steel Sheet 101]

The steel sheet 101 is used as a base metal of the steel sheet for containers 10 in the present embodiment. The steel sheet 101 used in the present embodiment is not particularly limited and known steel sheets that are typically used as a material for containers can be used. The methods for producing these known steel sheets and materials are not particularly limited and the steel sheets may be produced through known processes of hot rolling, pickling, cold rolling, annealing, temper rolling, and the like from a typical steel piece production process.

[Regarding Underlying Ni Layer 103]

The underlying Ni layer 103 is formed on the surface of the steel sheet 101, as shown in FIGS. 1A and 1B. The underlying Ni layer 103 is a Ni-based coated layer composed of Ni or a Fe—Ni alloy and at least containing Ni in an amount of 5 $mg/m^2$ to 150 $mg/m^2$ in terms of the amount of metal Ni. The underlying Ni layer 103 is formed by performing Ni coating or Fe—Ni alloy coating on the steel sheet 101.

The Ni-based coated layer composed of Ni or a Fe—Ni alloy is formed to ensure lacquer adhesion, film adhesion, corrosion resistance, and weldability. Since Ni is a highly corrosion-resistant metal, the corrosion resistance of an alloy layer including Fe and Sn formed by Ni coating at the time of reflow treatment, which will be described later, can be improved. The effect of improving the lacquer adhesion, film adhesion, corrosion resistance, and weldability of the alloy layer by Ni begins to be exhibited when the amount of metal Ni in the underlying Ni layer 103 is 5 $mg/m^2$ or more. As the Ni content increases, the effect of improving the corrosion resistance of the alloy layer increases. Therefore, the amount of metal Ni in the underlying Ni layer 103 is set to 5 $mg/m^2$ or more.

In addition, the amount of metal Ni in the underlying Ni layer 103 is set to 150 $mg/m^2$ or less. This is because when the amount of metal Ni in the underlying Ni layer 103 is more than 150 $mg/m^2$, not only is the effect of improving lacquer adhesion, film adhesion, corrosion resistance, and weldability saturated, but it is also economically disadvantageous to perform Ni coating in an amount of more than 150 $mg/m^2$ due to the fact that Ni is an expensive metal.

The amount of metal Ni in the underlying Ni layer 103 is further preferably 5 $mg/m^2$ to 100 $mg/m^2$.

Further, when Ni diffusion coating is performed, Ni coating is performed and then a diffusion treatment is performed in an annealing furnace to form a Ni diffusion layer. After, before, or coincident with the Ni diffusion treatment, a nitriding treatment may be performed. Even when the nitriding treatment is performed, both the effect of Ni and the effect of a nitriding treatment layer can be exhibited in the underlying Ni layer 103 in the present embodiment.

As a Ni coating or Fe—Ni alloy coating method, for example, known methods performed in general electrocoating methods can be used.

[Regarding Sn Coated Layer 105]

As shown in FIGS. 1A and 1B, the Sn coated layer 105 is formed on the underlying Ni layer 103 by Sn coating. The Sn coated layer 105 is a coated layer at least containing Sn in an amount of 300 $mg/m^2$ to 3,000 $mg/m^2$ in terms of the amount of metal Sn.

"Sn coating" used in the specification refers to not only coating by metal tin but also coating by metal tin with inevitable impurities or metal tin to which trace elements are added. A Sn coating method is not particularly limited and for example, a known electrocoating method is preferably used. A coating method of dipping a steel sheet into molten Sn may be used.

The Sn coated layer 105 by the Sn coating is formed to ensure corrosion resistance and weldability. Since the corrosion resistance of Sn itself is high, excellent corrosion resistance and weldability can be exhibited in metal tin or an alloy formed by the reflow treatment, which will be described later.

The excellent corrosion resistance of Sn becomes remarkable when the amount of metal Sn is 300 mg/m$^2$ or more, and as the Sn content increases, the degree of corrosion resistance also increases. Accordingly, the amount of metal Sn in the Sn coated layer 105 is set to 300 mg/m$^2$ or more. In addition, since the corrosion resistance-improving effect is saturated when the amount of metal Sn is more than 3,000 mg/m$^2$, the amount of Sn is set to 3,000 mg/m$^2$ or less from the economic viewpoint.

In addition, since Sn having a low electric resistance is soft and spreads by being pressurized between electrodes at the time of welding, a stable electrification region can be reliably ensured. Thus, particularly excellent weldability is exhibited. This excellent weldability is exhibited when the amount of metal Sn is 100 mg/m$^2$ or more. Further, in the above-described range of the amount of metal Sn exhibiting excellent corrosion resistance, the effect of improving weldability is not saturated. From the above reasons, in order to ensure excellent corrosion resistance and weldability, the amount of metal Sn is set to 300 mg/m$^2$ or more and 3,000 mg/m$^2$ or less.

The amount of metal Sn in the Sn coated layer 105 is further preferably 300 mg/m$^2$ to 2,000 mg/m$^2$.

After the above-described Sn coating is performed, a molten tin treatment (reflow treatment) is performed. The reflow treatment is performed to improve the corrosion resistance of an alloy layer that is a Sn—Fe or Sn—Fe—Ni alloy layer formed by melting Sn and forming an alloy with the underlying steel sheet 101 or the underlying Ni layer 103, and to form a Sn alloy composed of island-shaped Sn (island-shaped tin). This island-shaped Sn alloy can be formed by appropriately controlling the reflow treatment. In addition, the surface of the Sn coated layer 105 (the surface opposite to the interface with the underlying Ni layer 103) is oxidized by the appropriately controlled reflow treatment, and the oxide layer 107, which will be described later, is formed on the Sn coated layer 105.

[Regarding Oxide Layer 107]

As shown in FIGS. 1A and 1B, the oxide layer 107 containing tin oxide is formed on the Sn coated layer 105. This oxide layer 107 contains tin oxide in such an amount that the amount of electricity required for the reduction of the oxide layer 107 is 0.3 mC (millicron)/cm$^2$ to 10 mC/cm$^2$. By forming such an oxide layer 107 on the Sn coated layer 105, the sulfide stain resistance of the steel sheet for containers 10 can be improved.

The sulfide stain occurs by black SnS formed by reaction of metal Sn with sulfur S. Accordingly, in the case of the steel sheet for containers having the Sn coated layer, sulfur S included in an object to be preserved in a container such as foods reacts with metal Sn in the Sn coated layer to cause sulfide stain. Therefore, by forming the oxide layer 107 including tin oxide on the Sn coated layer 105, diffusion of sulfur atoms S to the interface with the Sn coated layer105 can be inhibited and thus sulfide stain resistance is improved. As a result, even when the amount of the chemical treatment layer coated onto the oxide layer 107 is reduced, excellent sulfide stain resistance can be achieved.

The above-described sulfide stain resistance is remarkably exhibited when the tin oxide content (the amount of tin oxide) included in the oxide layer 107 is equal to or more than the amount corresponding to an amount of 0.3 mC/cm$^2$ of electricity required for the reduction of the oxide layer 107. Accordingly, the amount of tin oxide contained in the oxide layer 107 is set to be equal to or more than the amount corresponding to an amount of 0.3 mC/cm$^2$ of electricity required for the reduction of the oxide layer 107. On the other hand, the oxide layer including tin oxide is a brittle film and when the amount of film coated is excessively increased, the chemical treatment layer 109 to be formed on the oxide layer 107 is easily peeled off. Accordingly, from the viewpoint of adhesion between the oxide layer 107 and the chemical treatment layer 109, the amount of tin oxide included in the oxide layer 107 is set to be equal to or less than the amount corresponding to an amount of 10 mC/cm$^2$ of electricity required for the reduction of the oxide layer 107. The amount of metal Sn in the oxide layer 107 is further preferably an amount corresponding to an amount of 5.5 mC/cm$^2$ to 10 mC/cm$^2$.

A method for measuring the amount of electricity required for the reduction of the oxide layer 107 will be described below again.

In the related art, sulfide stain resistance of a steel sheet for containers which had been coated with Sn was achieved by using a film containing Cr. Therefore, there were a lot of uncertainties in techniques of achieving sulfide stain resistance without using Cr. However, in the present embodiment, by forming the oxide layer 107 including tin oxide in the above-described amount in terms of metal Sn on the Sn coated layer 105, sulfide stain resistance can be easily improved without using Cr.

The oxide layer 107 can be formed by performing a reflow treatment for forming island-shaped Sn in the Sn coated layer 105 at an appropriate temperature for an appropriate time as described above. The term "island-shaped" refers to a state in which the surface of the underlying layer is not completely covered by an upper layer and the underlying layer is partially exposed. That is, the "island-shaped Sn coated layer" refers to a state in which the surface of the underlying Ni layer including alloy coating is not completely covered by the Sn coated layer and is partially exposed. The reflow treatment in which the Sn coated layer 105 and the oxide layer 107 can be appropriately formed is performed in such a way that, after Sn coating, the temperature is raised to 200° C. or higher and 300° C. or lower by heating such as electric resistance heating, induction heating, or the like for 0.2 seconds or longer and 20 seconds or shorter, and rapid cooling to about room temperature (for example, about 50° C.) is performed by cold water immediately after a metal gloss is obtained.

[Regarding Chemical Treatment Layer 109]

As shown in FIGS. 1A and 1B, the chemical treatment layer 109 is formed on the oxide layer 107. The chemical treatment layer 109 is a composite film layer mainly including a zirconium compound at least containing Zr in an amount of 1 mg/m$^2$ to 500 mg/m$^2$ in terms of the amount of metal Zr, and phosphoric acid in an amount of 0.1 mg/m$^2$ to 100 mg/m$^2$ in terms of the amount of P (in other words, at least containing a Zr component and a phosphoric acid component).

When each of the above-described Zr component and the phosphoric acid component individually forms a Zr film or a phosphoric acid film, a certain degree of effect related to corrosion resistance and adhesion is recognized but sufficient practical performance cannot be exhibited. However, when the chemical treatment layer 109 is formed as a composite film obtained by compounding a Zr component with a phosphoric acid component as the chemical treatment layer 109 of the present embodiment, excellent practical performance can be exhibited.

The Zr component included in the chemical treatment layer 109 in the present embodiment has a function of improving corrosion resistance, adhesion and working adhesion. The Zr component in the present embodiment is composed of, for example, plural Zr compounds such as zirconium hydroxide and zirconium fluoride, in addition to zirconium oxide or zirconium phosphate. Since such a Zr component has excellent corrosion resistance and adhesion, as the amount of the Zr component contained in the chemical treatment layer 109 increases, the corrosion resistance and adhesion of the steel sheet for containers 10 are improved.

Specifically, when the Zr component content as the chemical treatment layer 109 coated onto the oxide layer 107 is 1 mg/m$^2$ or more in terms of the amount of metal Zr, corrosion resistance and lacquer adhesion at a level causing no practical problems are ensured. On the other hand, as the Zr component content increases, the effect of improving corrosion resistance and coating adhesion increases. However, when the Zr component content is more than 500 mg/m$^2$ in terms of the amount of metal Zr, the thickness of the chemical treatment layer 109 is excessively increased and the adhesion of the chemical treatment film itself is deteriorated (mainly caused by cohesive fracture). Also, electric resistance increases and weldability is deteriorated. In addition, when the Zr component content is more than 500 mg/m$^2$ in terms of the amount of metal Zr, uneven coating of the chemical treatment film is exhibited with an uneven appearance. Accordingly, the Zr component content (that is, the Zr content) in the steel sheet for containers 10 of the present embodiment is set to 1 mg/m$^2$ to 500 mg/m$^2$ in terms of the amount of metal Zr. The Zr component content is preferably 2 mg/m$^2$ to 50 mg/m$^2$ in terms of the amount of metal Zr.

Further, the above-described chemical treatment layer 109 further includes a phosphoric acid component formed of one or two or more of phosphoric acid compounds in addition to the above-described Zr component.

The phosphoric acid component in the present embodiment has a function of improving corrosion resistance, adhesion, and working adhesion. The phosphoric acid component in the present embodiment is composed of a composite component of one phosphoric acid compound or two or more phosphoric acid compounds, such as iron phosphate, nickel phosphate, tin phosphate, and zirconium phosphate, formed by reaction with the underlying layers (the steel sheet 101, underlying Ni layer 103, Sn coated layer 105, and oxide layer 107) or the Zr component. Since such a phosphoric acid component has excellent corrosion resistance and adhesion, as the amount of the phosphoric acid component to be formed increases, the corrosion resistance and adhesion of the steel sheet for containers 10 are improved.

Specifically, when the phosphoric acid component content in the chemical treatment layer 109 is 0.1 mg/m$^2$ or more in terms of the amount of P, corrosion resistance and lacquer adhesion at a level causing no practical problems are ensured. On the other hand, as the phosphoric acid component content increases, the effect of improving corrosion resistance and lacquer adhesion also increases. However, when the phosphoric acid component content is more than 100 mg/m$^2$ in terms of the amount of P, the thickness of the chemical treatment layer 109 is excessively increased and the adhesion of the chemical treatment layer itself (mainly caused by cohesive failure) is deteriorated. Also, electric resistance increases and weldability is deteriorated. In addition, when the phosphoric acid component content is more than 100 mg/m$^2$ in terms of the amount of P, uneven coating of the chemical treatment layer is exhibited with an uneven appearance. Accordingly, the phosphoric acid component content in the steel sheet for containers 10 of the present embodiment is set to 0.1 mg/m$^2$ to 100 mg/m$^2$ in terms of the amount of P. The phosphoric acid component content is more preferably 0.5 mg/m$^2$ to 30 mg/m$^2$ in terms of the amount of P.

In the steel sheet for containers 10 of the present embodiment, in order to form the oxide layer 107 on the lower layer of the above-described chemical treatment layer 109, for example, even when the amount of metal Zr is a low film amount of 2 mg/m$^2$ or like, excellent sulfide stain resistance can be achieved. As a result, since the adhesion amount of the chemical treatment layer 109 can be further reduced, cost reduction can be achieved.

The chemical treatment layer 109 including the above-described Zr component and phosphoric acid component is formed by an electrolysis treatment (for example, cathodic electrolysis treatment). In order to form the chemical treatment layer by an electrolysis treatment, it is necessary to determine components in a chemical treatment solution according to the type of the chemical treatment layer to be formed. Specifically, a chemical treatment solution including 10 ppm or more and 10,000 ppm or less of Zr ions, 10 ppm or more and 10,000 ppm or less of fluoride ions (F), 10 ppm or more and 3,000 ppm or less of phosphate ions, and 100 ppm or more and 3,000 ppm or less of nitrate ions and/or sulfate ions is used. In addition, as required, a phenolic resin or the like may be further added to the chemical treatment solution thereof.

The temperature of the chemical treatment solution is set to 5° C. or higher and lower than 90° C. When the temperature of the chemical treatment solution is lower than 5° C., the film forming efficiency is poor and is not economical. Thus, this case is not preferable. In addition, when the temperature of the chemical treatment solution is 90° C. or higher, the structure of the film to be formed is not even, and thus defects, cracks, microcracks and the like are generated. As a result, dense film formation is difficult and defects, cracks, microcracks and the like easily serve as origins for corrosion and the like. Thus, this case is not preferable.

Such an electrolysis treatment is performed at a current density of 1.0 A/dm$^2$ or more and 100 A/dm$^2$ or less for an electrolysis treatment time of 0.2 seconds or longer and 150 seconds or shorter. When the current density is less than 1.0 A/dm$^2$, the adhesion amount of the chemical treatment layer is reduced and a long electrolysis treatment time is required so that the productivity is deteriorated. Thus, this case is not preferable. In addition, when the current density is more than 100 A/dm$^2$, the adhesion amount of the chemical treatment layer is more than a required amount and becomes saturated. In some cases, the insufficiently adhered film may be washed off (peeled off) in a washing process by rinsing or the like after electrolysis chemical treatment. Thus, this case is not economical. Further, when the electrolysis treatment time is shorter than 0.2 seconds, the adhesion amount of film is reduced and corrosion resistance, lacquer adhesion and the like are deteriorated. Thus, this case is not preferable. When the electrolysis treatment time is longer than 150 seconds, the adhesion amount of film is more than a required amount and the adhesion amount becomes saturated. In some cases, the insufficiently adhered film may be washed off (peeled off) in a washing process by rinsing or the like after electrolysis chemical treatment. Thus, this case is not economical.

In addition, the pH is preferable in a range of 3.1 to 3.7, and more preferably around 3.5. Further, nitric acid, ammonia, or the like may be added to adjust the pH as required.

When the electrolysis treatment is performed at the above-described electrolysis current density for the above-described energizing time, it is possible to form a film with an appropriate adhesion amount on the surface of the steel sheet.

When the chemical treatment layer of the present embodiment is formed, tannic acid may be further added to an acid solution used for the electrolysis treatment. By adding tannic acid to the acid solution, the tannic acid reacts with iron (Fe) on the surface of the steel sheet during the above-described treatment and a film of iron tannate is formed on the surface of the steel sheet. Since this film of iron tannate improves rust resistance and adhesion, as required, formation of the chemical treatment layer may be performed in an acid solution to which tannic acid is added.

In addition, as the solvent of the acid solution used for formation of the chemical treatment layer, for example, distilled water and the like can be used. However, the solvent of the acid solution in the present embodiment is not limited thereto and can be appropriately selected depending on dissolved materials, formation methods, formation conditions of chemical treatment layers, and the like. However, it is preferable to use distilled water in terms of stable industrial productivity, cost, and the environment.

In the chemical treatment solution used for forming the chemical treatment layer of the present invention, for example, a Zr complex such as $H_2ZrF_6$ can be used as the supply source of Zr. Zr in the above-described Zr complex becomes $Zr^{4+}$ due to a hydrolysis reaction resulting from an increase in pH at the cathodic electrode interface and is present in the chemical treatment solution. Such Zr ions more rapidly react with the chemical treatment solution and form a compound such as $ZrO_2$ or $Zr_3(PO_4)_4$. The compound is subjected to a dehydration condensation reaction with a hydroxyl group (—OH) present on the surface of the metal or the like and thus a Zr film can be formed. In addition, when a phenolic resin is added to the chemical treatment solution, the phenolic resin may be subjected to amino alcohol modification to be made soluble to water.

The above-described steel sheet for containers 10 of the present embodiment exhibits excellent sulfide stain resistance even when the adhesion amount of the chemical treatment layer on the oxide layer 107 is reduced. For example, a lacquer is applied to the surface of the steel sheet for containers 10 and baked to form a lacquer. Then, the steel sheet for containers 10 in which a lacquer is formed is placed and fixed onto the opening of a heat-resistant bottle in which a 0.6% by mass L-cysteine solution which has been boiled for 1 hour is stored as a lid and a heat treatment is performed at 110° C. for 30 minutes. In this case, when the appearance of a contact portion where the steel sheet is brought into contact with the heat-resistant bottle is observed in the steel sheet for containers 10 in which the lacquer is formed after the heat treatment, the steel sheet for containers 10 of the present embodiment exhibits excellent sulfide stain resistance in which 50% or more of the area of the contact portion does not become black.

<Regarding Method for Measuring Content of Each Component>

The amount of metal Ni in the underlying Ni layer 103 or the amount of metal Sn in the Sn coated layer 105 can be measured by, for example, a fluorescent X-ray analysis. In this case, a calibration curve related to the amount of metal Ni is specified in advance using a sample for the amount of Ni coated in which the amount of metal Ni is already known, and the amount of metal Ni is relatively specified using the same calibration curve. Similar to the amount of metal Sn, a calibration curve related to the amount of metal Sn is specified in advance using a sample for the amount of Sn coated in which the amount of metal Sn is already known, and the amount of metal Sn is relatively specified using the same calibration curve.

The amount of electricity required for the reduction of the oxide layer 107 can be determined from a potential-time curve obtained by cathodic electrolysis of the steel sheet for containers 10 of the present embodiment at a constant current of 0.05 mA/cm$^2$ in 0.001 mol/L of a hydrobromic acid solution from which dissolved oxygen is removed by means of such as bubbling of nitrogen gas. Hereinafter, a method for measuring the amount of electricity required for the reduction will be described simply with reference to FIGS. 2A and 2B.

Figure 2A:
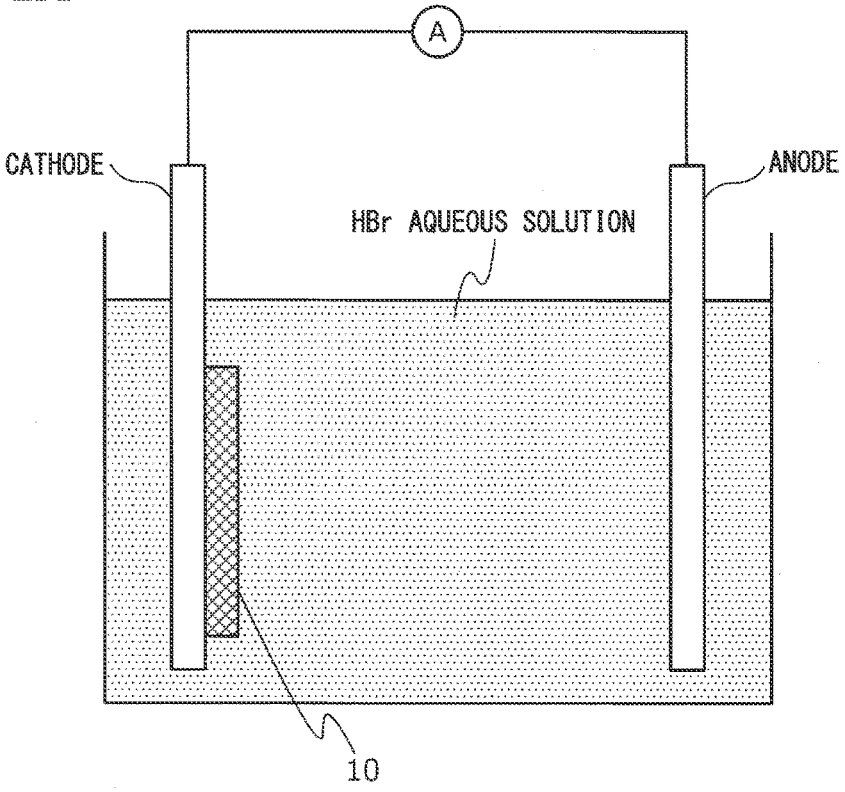
FIG. 2A is an explanatory view showing a method for measuring a tin oxide content in an oxide layer.
Figure 2B:
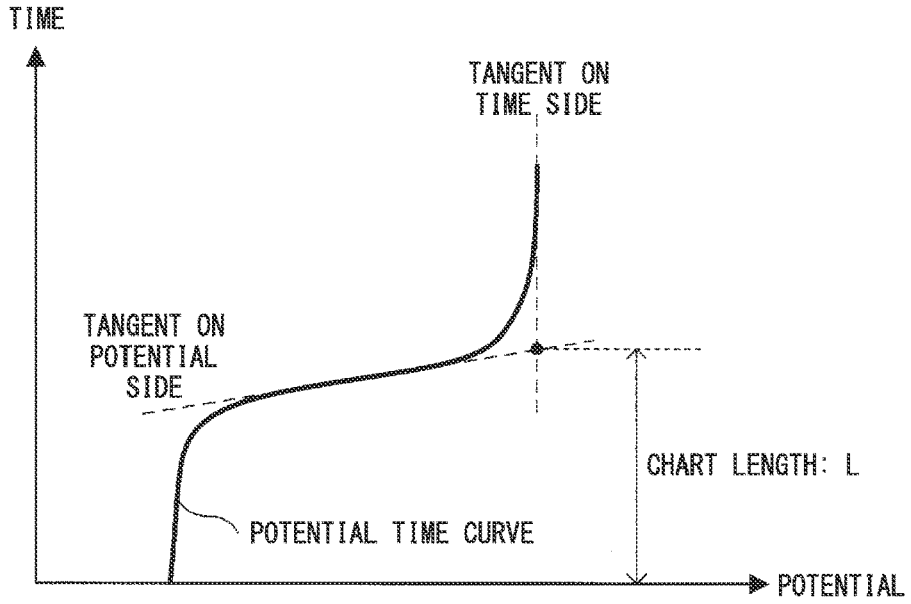
FIG. 2B is an explanatory view showing the method for measuring a tin oxide content in the oxide layer.

FIGS. 2A and 2B are explanatory views showing a method for measuring a tin oxide content (the amount of tin oxide) in an oxide layer. As shown in FIG. 2A, in the measurement of the amount of tin oxide, first, a bath for electrolysis treatment in which a hydrobromic acid aqueous solution (HBr aqueous solution) with the above-described density from which dissolved oxygen is removed is stored is prepared. In the bath for electrolysis treatment, an anode and a cathode provided with a measurement sample (that is, the steel sheet for containers 10) are arranged. The material for the anode and the cathode is not particularly limited and for example, for the anode and the cathode, platinum electrodes can be used. In addition, the test piece as it is can be used for the cathode.

Next, a cathodic electrolysis treatment is performed at a constant current of 0.05 mA/cm$^2$ and a potential-time curve is measured. The full-scale length $L_{FS}$ (unit: mm) of the obtained measuring chart of the potential-time curve (hereinafter, also simply referred to as a "chart") and the feeding speed $T_{FS}$ (unit: sec) of the full-scale chart are specified in advance.

FIG. 2B schematically shows a measuring chart that can be obtained. In the obtained chart, as shown in FIG. 2B, each of a tangent on the potential axis side and a tangent on the time axis side is specified and the position of the intersection of the tangents is specified. The length of a perpendicular line drawn from this intersection to the potential axis is set to a chart length L (unit: mm), as shown in FIG. 2B.

When the amount of electricity required for the reduction of the oxide layer 107 (unit: mC/cm$^2$) is referred to as an amount of tin oxide Q, the amount of tin oxide Q can be calculated by the following equation 101. In the following equation 101, I represents a current density (unit: mA), S represents an area of a sample (unit: cm$^2$), and T represents the time required for completely removing the oxide layer 107 (that is, completely reducing the oxide layer 107) (unit: sec). In addition, the time T required for completely removing the oxide layer 107 can be calculated by the following equation 102 using the full-scale length $L_{FS}$, the feeding speed $T_{FS}$ of the full-scale chart, and the chart length L obtained from the measuring chart. Accordingly, the amount of tin oxide Q can be calculated by using the following equations 101 and 102.

[Equation 1]

$$Q = \frac{I}{S} \times T \quad \text{Equation 101}$$

$$T = \frac{T_{FS}}{L_{FS}} \times L \quad \text{Equation 102}$$

Further, the amount of metal Zr and the amount of P in the chemical treatment layer 109 can be measured by, for example, a quantitative analysis method such as fluorescent X-ray analysis or the like.

The method for measuring the amount of each of the above-described components is not limited to the above-described method and other known measurement methods can be used.

<Method for Evaluating Sulfide Stain Resistance with Naked Eye>

Figure 3A:
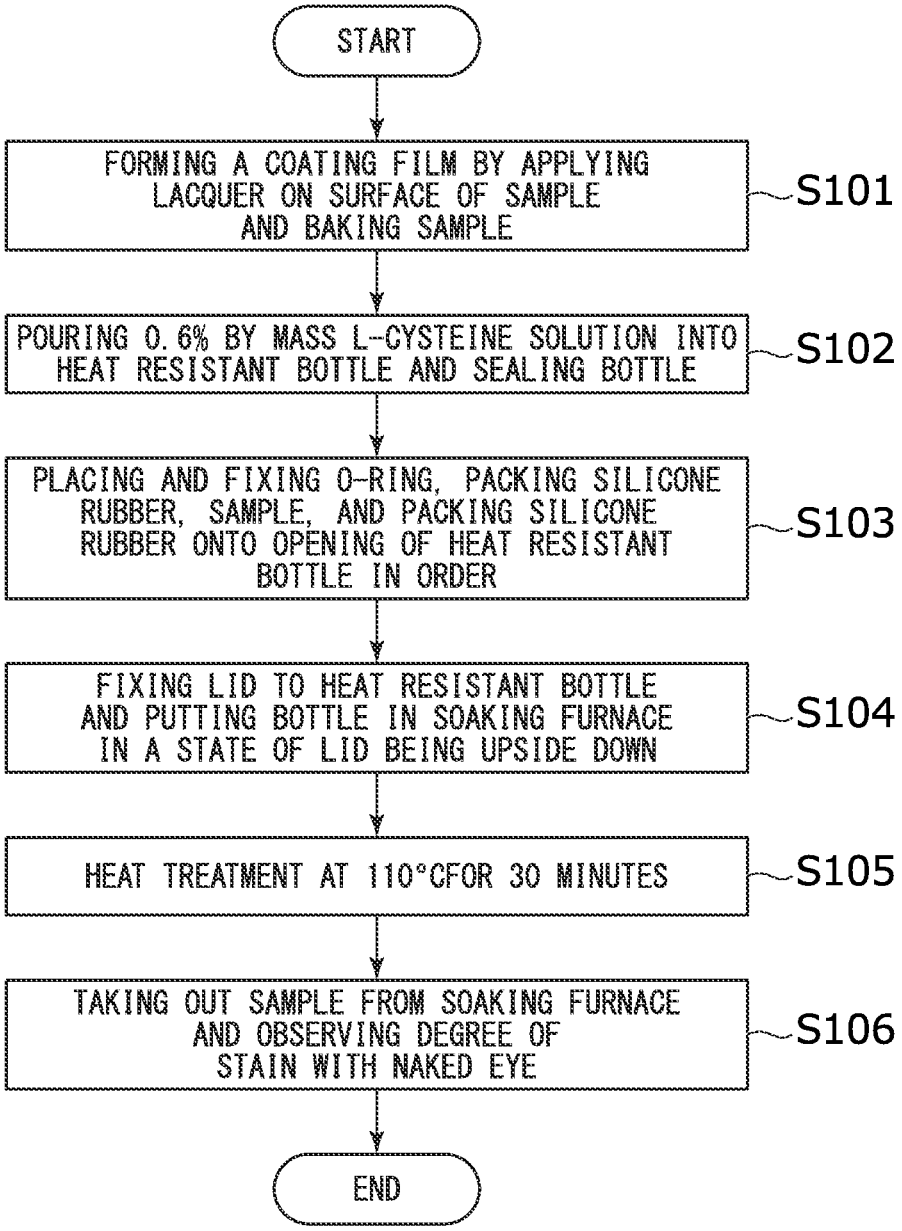
FIG. 3A is a flow chart explaining an example of a flow of a method for evaluating sulfide stain resistance.
Figure 3B:
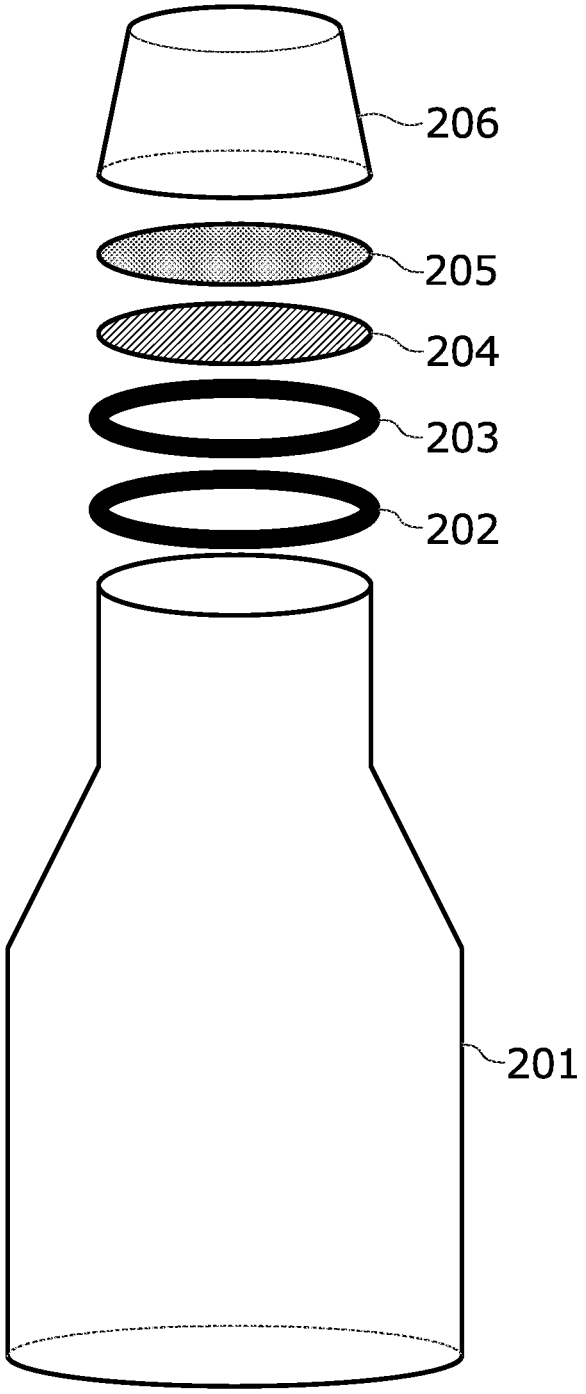
FIG. 3B is an explanatory view showing the method for evaluating sulfide stain resistance.

Next, with reference to FIGS. 3A and 3B, a method for evaluating sulfide stain resistance will be described in detail. FIG. 3A is a flow chart explaining an example of a flow of a method for evaluating sulfide stain resistance. FIG. 3B is an explanatory view showing the method for evaluating sulfide stain resistance.

In the method for evaluating the sulfide stain resistance of the present embodiment, a gold lacquer (28S93 MB, manufactured by Valsper Corporation) is applied to the surface of the sample and the sample is baked to form a lacquer (Step S101). For the sample, the steel sheet for containers in which the underlying Ni layer, the Sn coated layer, the oxide layer, and the chemical treatment layer are formed on the surface of the steel sheet by the above-described method is used.

A 0.6% by mass L-cysteine solution which has been boiled for 1 hour is poured into a heat-resistant bottle 201 (a 100 mL heat resistance bottle, 017260-100A, manufactured by SCHOTT AG) and the bottle is sealed (Step S102).

An O-ring 202, a packing silicone rubber 203, a sample 204 (42 Φ) prepared in Step S201, and a packing silicone rubber 205 are placed and fixed onto the opening of the heat-resistant bottle in this order (Step S103).

The heat-resistant bottle is capped with a lid 206 (GL45, manufactured by SIBATA SCIENTIFIC TECHNOLOGY LTD., inner diameter: 45Φ, outer diameter: 55Φ) and is put into a soaking furnace such that the lid is directed downward (Step S104).

In the soaking furnace, the heat-resistant bottle is subjected to a heat treatment at 110° C. for 30 minutes (Step S105).

The heat-resistant bottle is taken out from the soaking furnace, the degree of stain at the contact portion of the sample and the L-cysteine solution is observed with the naked eye (Step S106).

<Regarding Method for Evaluating Sulfide Stain Resistance by YI>

When a yellowness index (YI) determined according to its K-7373 is used to evaluate sulfide stain resistance, in the above-described Step S101, a gold lacquer (28S93 MB, manufactured by Valsper Corporation) is applied to the surface of the sample 204 and the sample is baked to form a lacquer.

Steps S102 to 105 are common to the method for evaluating sulfide stain resistance with the naked eye and the method for evaluating sulfide stain resistance by YI.

In the method for evaluating sulfide stain resistance by YI, in the above-described Step S106, the yellowness index of the sample after reacting with the L-cysteine solution is measured using a spectral colorimeter. It is preferable to use a spectral colorimeter according to the condition c of JIS Z-8722 in the measurement of the yellowness index, and as the measurement method, SCI (including regular reflection light) measurement which is hardly affected by surface properties is performed.

The measurement has to be performed under predetermined conditions of a light source, humidity, temperature and the like as for the measurement conditions.

In the above description, the configuration of the steel sheet for containers 10 of the present embodiment has been described in detail with reference to FIGS. 1A to 3B.

<Regarding Method for Producing Steel Sheet for Containers>

Figure 4:
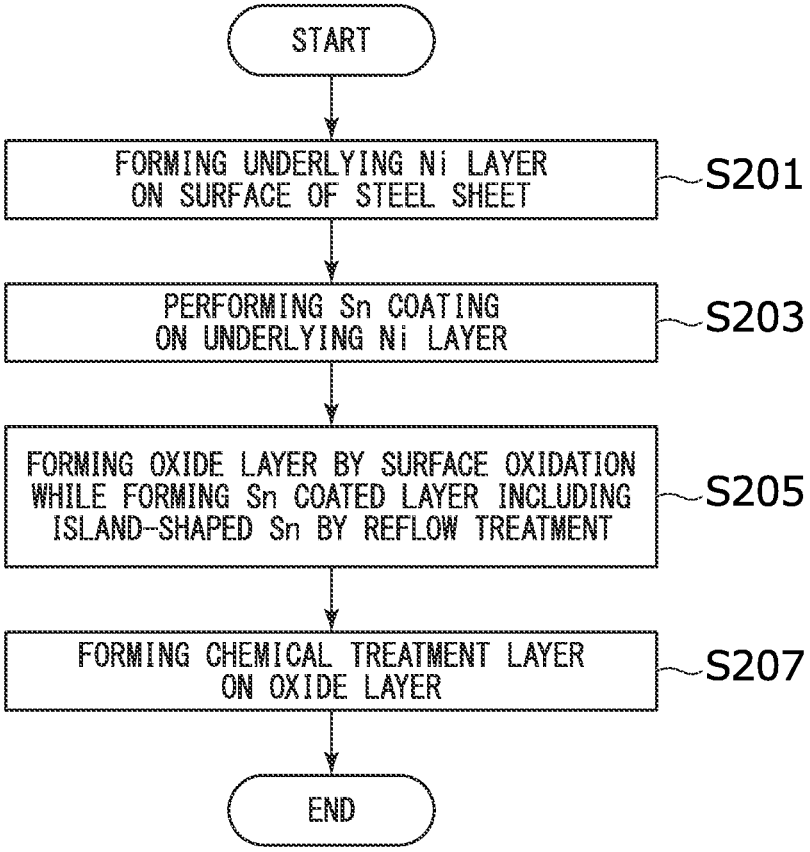
FIG. 4 is a flow chart explaining an example of a flow of a method for producing a steel sheet for containers according to the present embodiment.

Next, a method for producing the steel sheet for containers 10 of the present embodiment will be described in detail with reference to FIG. 4. FIG. 4 is a flow chart explaining an example of a flow of a method for producing a steel sheet for containers according to the present embodiment.

In the method for producing the steel sheet for containers 10 of the present embodiment, first, Ni coating or Fe—Ni alloy coating is performed on the steel sheet 101 to form an underlying Ni layer 103 (Step S201).

Next, Sn coating is performed on the steel sheet 101 in which the underlying Ni layer 103 is formed (Step S203). Then, an oxide layer 107 is formed by surface oxidation while forming a Sn coated layer 105 including island-shaped Sn by a molten tin treatment (reflow treatment) (Step S205).

Then, a chemical treatment layer 109 is formed on the oxide layer 107 by an electrolysis treatment (Step S207).

The steel sheet for containers 10 of the present embodiment is produced by performing the treatment by this flow.

EXAMPLES

Hereinafter, the steel sheet for containers and the method for producing a steel sheet for containers of the present invention will be described in detail while showing Examples and Comparative Examples. Examples shown below are merely examples of the steel sheet for containers and the method for producing a steel sheet for containers of the present invention and the steel sheet for containers and the method for producing a steel sheet for containers of the present invention are not limited to Examples shown below.

Examples

A steel sheet generally used as a steel sheet for containers was used and Ni coating and Sn coating were sequentially performed on the steel sheet by a known method. Subsequently, a reflow treatment was performed under the conditions shown in Table 1 below and a Sn coated layer and an oxide layer were formed. Then, a chemical treatment layer was formed under the conditions shown in Table 1 below.

The amount of metal Ni in the formed underlying Ni layer and the amount of metal Sn in the Sn coated layer were measured by fluorescent X-ray analysis and the results are shown in Table 2 below. In addition, the amount of tin oxide in the oxide layer was measured by the method described with reference to FIGS. 2A and 2B and the results are shown in Table 2 below. In addition, the amount of each component in the chemical treatment layer was measured by fluorescent X-ray analysis and the results are shown in Table 2 below.

In the evaluation of sulfide stain resistance, the sulfide stain resistance of samples of each level was observed with the naked eye and evaluated by the method described with reference to FIGS. 3A and 3B. In the samples of each level, the appearance of the contact portion in which the steel sheet was brought into contact with the heat-resistant bottle was observed and evaluation points of 1 to 10 were assigned to the samples according to a ratio of a portion with stain occupied with the contact portion (area ratio). In this evaluation method, when the evaluation point was 8 or higher (that is, when stain did not occur in 50% or more of the contact portion), the steel sheet for containers exhibited excellent sulfide stain resistance.

10 Points: The area of a portion with stain was less than 10%.

9 Points: The area of a portion with stain was 10% or more and less than 30%.

8 Points: The area of a portion with stain was 30% or more and less than 50%.

7 Points: The area of a portion with stain was 50% or more and less than 60%.

6 Points: The area of a portion with stain was 60% or more and less than 65%.

5 Points: The area of a portion with stain was 65% or more and less than 75%.

4 Points: The area of a portion with stain was 75% or more and less than 85%.

3 Points: The area of a portion with stain was 85% or more and less than 90%.

2 Points: The area of a portion with stain was 90% or more and less than 95%.

1 Point: The area of a portion with stain was 95% or more.

TABLE 1

| Level | Reflow treatment temperature [° C.] | Reflow treatment time [sec] | Zr ion [ppm] | Fluoride ion [ppm] | Phosphate ion [ppm] | Nitrate ion [ppm] | Electrolysis treatment temperature [° C.] | Current density [A/dm$^2$] | Electrolysis treatment time [sec] | Remarks |
|---|---|---|---|---|---|---|---|---|---|---|
| A1 | 304 | 17.5 | 1977 | 4781 | 2196 | 23108 | 21.2 | 19.3 | 20.2 | Comparative Example |
| A2 | 288 | 13.2 | 8880 | 1431 | 2933 | 9041 | 75.6 | 52.5 | 148.6 | Example |
| A3 | 219 | 12.8 | 4909 | 3497 | 2007 | 6217 | 44.3 | 13.7 | 40.4 | Example |
| A4 | 181 | 16.4 | 9724 | 8170 | 1822 | 24167 | 44.3 | 8.0 | 57.9 | Comparative Example |
| A5 | 244 | 20.9 | 8992 | 5958 | 289 | 16531 | 89.2 | 49.5 | 20.2 | Comparative Example |
| A6 | 210 | 19.5 | 3881 | 2677 | 2347 | 1140 | 48.6 | 16.6 | 141.7 | Example |
| A7 | 240 | 4.27 | 9969 | 3795 | 213 | 12933 | 88.7 | 97.6 | 62.4 | Example |
| A8 | 269 | 0.10 | 5332 | 7704 | 1619 | 15244 | 19.9 | 55.5 | 138.3 | Comparative Example |
| A9 | 249 | 11.0 | 10438 | 9490 | 1650 | 10326 | 63.8 | 34.5 | 127.5 | Comparative Example |
| A10 | 208 | 14.4 | 9224 | 7641 | 521 | 15500 | 48.6 | 90.3 | 1.2 | Example |
| A11 | 208 | 12.9 | 9.2 | 7972 | 393 | 14377 | 30.0 | 3.7 | 146.4 | Comparative Example |
| A12 | 260 | 15.9 | 8322 | 10659 | 139 | 3968 | 19.9 | 47.0 | 147.2 | Comparative Example |
| A13 | 229 | 4.0 | 5788 | 9993 | 1632 | 2537 | 54.8 | 19.4 | 13.3 | Example |
| A14 | 237 | 17.6 | 9676 | 10 | 2358 | 14823 | 45.0 | 79.9 | 111.5 | Example |
| A15 | 249 | 2.4 | 9676 | 9.6 | 6 | 15094 | 84.9 | 77.5 | 12.4 | Comparative Example |
| A16 | 283 | 6.8 | 4178 | 1213 | 3055 | 26568 | 64.2 | 6.5 | 66.3 | Comparative Example |
| A17 | 283 | 9.2 | 1236 | 610 | 2941 | 24007 | 53.2 | 63.4 | 72.2 | Example |
| A18 | 271 | 2.3 | 545 | 2549 | 10 | 4545 | 83.2 | 34.7 | 126.2 | Example |
| A19 | 209 | 2.5 | 6967 | 3356 | 9.5 | 14177 | 89.7 | 17.0 | 77.2 | Comparative Example |
| A20 | 231 | 7.8 | 6159 | 7786 | 167 | 30518 | 43.4 | 73.8 | 15.0 | Comparative Example |
| A21 | 201 | 0.2 | 7266 | 663 | 1136 | 28788 | 35.9 | 54.4 | 139.9 | Example |
| A22 | 204 | 19.2 | 359 | 5603 | 452 | 102 | 17.0 | 60.2 | 48.6 | Example |
| A23 | 231 | 3.6 | 67 | 2309 | 1405 | 94 | 73.4 | 45.9 | 3.0 | Comparative Example |
| A24 | 231 | 11.7 | 9205 | 9673 | 2042 | 5735 | 92.9 | 21.6 | 142.9 | Comparative Example |
| A25 | 201 | 1.1 | 496 | 5342 | 1150 | 23764 | 85.7 | 80.3 | 77.1 | Example |
| A26 | 204 | 11.6 | 7661 | 3289 | 1934 | 21167 | 5.02 | 91.2 | 128.6 | Example |
| A27 | 231 | 10.3 | 2746 | 8448 | 2729 | 22956 | 4.55 | 95.3 | 18.0 | Comparative Example |
| A28 | 201 | 16.8 | 5346 | 6158 | 1241 | 10195 | 8.8 | 103.9 | 101.0 | Comparative Example |
| A29 | 231 | 14.0 | 8361 | 6269 | 957 | 4851 | 48.5 | 1.00 | 77.1 | Example |
| A30 | 201 | 8.9 | 8861 | 9482 | 401 | 25324 | 85.1 | 0.96 | 123.3 | Comparative Example |
| A31 | 283 | 11.1 | 6049 | 9312 | 892 | 27798 | 49.9 | 89.1 | 158.8 | Comparative Example |
| A32 | 274 | 0.2 | 9343 | 7945 | 2706 | 3194 | 48.5 | 1.8 | 142.5 | Example |
| A33 | 235 | 18.9 | 736 | 23 | 1590 | 1566 | 63.2 | 88.1 | 0.21 | Example |
| A34 | 234 | 15.7 | 8609 | 5867 | 142 | 10125 | 26.4 | 22.3 | 0.19 | Comparative Example |

TABLE 2

| Level | Amount of metal Ni [mg/m$^2$] | Amount of metal Sn [mg/m$^2$] | Amount of metal Zr [mg/m$^2$] | P [mg/m$^2$] | Amount of tin oxide [mC/cm$^2$] | Evaluation result of sulfide stain resistance | Remarks |
|---|---|---|---|---|---|---|---|
| A1 | 81.1 | 1771 | 411.0 | 81.2 | 11.2 | 1 | Comparative Example |
| A2 | 119.1 | 1883 | 414.6 | 23.0 | 6.9 | 8 | Example |
| A3 | 131.4 | 971 | 259.7 | 39.4 | 1.7 | 9 | Example |
| A4 | 87.6 | 247 | 52.1 | 92.9 | 0.2 | 1 | Comparative Example |
| A5 | 55.0 | 2408 | 444.3 | 82.4 | 11.1 | 1 | Comparative Example |
| A6 | 148.9 | 1757 | 261.6 | 40.7 | 7.0 | 8 | Example |
| A7 | 51.8 | 503 | 194.8 | 50.2 | 8.7 | 9 | Example |
| A8 | 138.8 | 1226 | 268.2 | 60.3 | 0.2 | 1 | Comparative Example |
| A9 | 112.8 | 278 | 563.2 | 30.0 | 7.2 | 1 | Comparative Example |
| A10 | 69.4 | 2830 | 252.4 | 9.6 | 8.3 | 9 | Example |
| A11 | 118.0 | 713 | 0.82 | 22.7 | 4.8 | 4 | Comparative Example |
| A12 | 48.8 | 1895 | 0.74 | 17.0 | 6.4 | 2 | Comparative Example |
| A13 | 25.0 | 593 | 156.8 | 55.2 | 8.3 | 10 | Example |
| A14 | 137.2 | 1758 | 30.5 | 5.3 | 7.5 | 9 | Example |
| A15 | 63.2 | 2206 | 0.70 | 0.08 | 6.3 | 2 | Comparative Example |
| A16 | 26.2 | 2178 | 33.0 | 107.0 | 2.6 | 7 | Comparative Example |
| A17 | 63.0 | 2267 | 206.6 | 39.9 | 6.1 | 9 | Example |
| A18 | 9.5 | 1016 | 165.8 | 3.1 | 6.2 | 8 | Example |
| A19 | 16.1 | 730 | 42.5 | 0.09 | 7.6 | 4 | Comparative Example |
| A20 | 18.4 | 2906 | 580.0 | 26.3 | 8.3 | 2 | Comparative Example |
| A21 | 25.3 | 2301 | 349.3 | 96.7 | 4.5 | 8 | Example |
| A22 | 46.8 | 517 | 130.5 | 44.7 | 7.7 | 10 | Example |
| A23 | 41.1 | 2706 | 0.82 | 91.2 | 1.9 | 1 | Comparative Example |
| A24 | 31.2 | 2409 | 532.0 | 96.2 | 3.6 | 4 | Comparative Example |
| A25 | 108.5 | 1747 | 200.5 | 72.1 | 0.9 | 8 | Example |
| A26 | 106.0 | 764 | 267.9 | 38.9 | 5.2 | 9 | Example |
| A27 | 90.5 | 1586 | 0.89 | 24.8 | 6.1 | 2 | Comparative Example |
| A28 | 133.3 | 2353 | 532.0 | 33.8 | 6.8 | 4 | Comparative Example |
| A29 | 69.2 | 1322 | 231.9 | 27.6 | 9.5 | 9 | Example |
| A30 | 90.5 | 990 | 0.94 | 92.1 | 8.1 | 1 | Comparative Example |
| A31 | 106.4 | 246 | 512.0 | 5.0 | 7.2 | 4 | Comparative Example |
| A32 | 66.5 | 2564 | 490.9 | 83.8 | 4.0 | 10 | Example |
| A33 | 92.3 | 2216 | 396.5 | 2.1 | 2.5 | 8 | Example |
| A34 | 70.3 | 632 | 0.45 | 41.0 | 2.4 | 2 | Comparative Example |

Next, under the conditions shown in Table 3 below, samples of each level were produced. The amount of each component of the samples was measured in the same manner as in the case of the above Table 2 and the sulfide stain resistance was evaluated with the naked eye by the same method as in the case of the above Table 2. The obtained results are shown in Table 4 below.

TABLE 3

| Level | Reflow treatment temperature [° C.] | Reflow treatment time [sec] | Zr ion [ppm] | Fluoride ion [ppm] | Phosphate ion [ppm] | Nitrate ion [ppm] | Electrolysis treatment temperature [° C.] | Current density [A/dm$^2$] | Electrolysis treatment time [sec] | Remarks |
|---|---|---|---|---|---|---|---|---|---|---|
| B1 | 204 | 9.9 | 288 | 4503 | 1124 | 3336 | 36.1 | 65.3 | 82.0 | Comparative Example |
| B2 | 283 | 7.2 | 7453 | 9801 | 1106 | 927 | 33.4 | 86.2 | 102.1 | Example |
| B3 | 238 | 13.9 | 1820 | 1167 | 1144 | 18561 | 25.7 | 38.3 | 50.6 | Example |
| B4 | 204 | 16.5 | 9903 | 6263 | 1515 | 29271 | 26.6 | 69.6 | 86.4 | Comparative Example |
| B5 | 283 | 17.0 | 5814 | 5637 | 376 | 22953 | 26.4 | 83.8 | 73.3 | Comparative Example |

TABLE 3-continued

| Level | Reflow treatment temperature [° C.] | Reflow treatment time [sec] | Zr ion [ppm] | Fluoride ion [ppm] | Phosphate ion [ppm] | Nitrate ion [ppm] | Electrolysis treatment temperature [° C.] | Current density [A/dm$^2$] | Electrolysis treatment time [sec] | Remarks |
|---|---|---|---|---|---|---|---|---|---|---|
| B6 | 294 | 1.2 | 4786 | 7708 | 2189 | 28489 | 18.4 | 94.9 | 112.8 | Example |
| B7 | 283 | 12.4 | 4280 | 537 | 1904 | 29004 | 32.4 | 14.8 | 127.8 | Example |
| B8 | 238 | 4.6 | 3426 | 1726 | 2846 | 7096 | 84.8 | 22.6 | 42.2 | Comparative Example |
| B9 | 268 | 8.9 | 11423 | 9106 | 2440 | 2865 | 31.5 | 90.9 | 24.5 | Comparative Example |
| B10 | 283 | 1.3 | 1387 | 5692 | 379 | 24799 | 8.8 | 96.3 | 69.0 | Example |
| B11 | 238 | 19.0 | 9938 | 8519 | 2793 | 21662 | 27.7 | 74.9 | 112.7 | Example |
| B12 | 204 | 13.1 | 7 | 1541 | 407 | 27628 | 3.3 | 31.8 | 95.2 | Comparative Example |
| B13 | 283 | 8.6 | 8820 | 5614 | 3201 | 19722 | 71.8 | 37.9 | 16.4 | Comparative Example |
| B14 | 294 | 0.5 | 6334 | 4603 | 1388 | 11613 | 34.2 | 64.8 | 69.0 | Example |
| B15 | 209 | 12.1 | 7953 | 8305 | 212 | 1113 | 71.0 | 14.5 | 111.9 | Example |
| B16 | 207 | 8.6 | 4958 | 9497 | 8 | 11363 | 60.5 | 16.3 | 59.1 | Comparative Example |
| B17 | 310 | 9.0 | 8785 | 9153 | 826 | 22530 | 9.9 | 83.3 | 47.2 | Comparative Example |
| B18 | 247 | 3.7 | 2571 | 2617 | 2928 | 29484 | 24.2 | 53.3 | 63.2 | Example |
| B19 | 253 | 1.0 | 1321 | 8184 | 450 | 16727 | 38.0 | 63.5 | 127.4 | Example |
| B20 | 180 | 10.2 | 1264 | 6484 | 305 | 28542 | 75.0 | 5.6 | 94.1 | Comparative Example |

TABLE 4

| Level | Amount of metal Ni [mg/m$^2$] | Amount of metal Sn [mg/m$^2$] | Amount of metal Zr [mg/m$^2$] | P [mg/m$^2$] | Amount of tin oxide [mC/cm$^2$] | Evaluation result of sulfide stain resistance | Remarks |
|---|---|---|---|---|---|---|---|
| B1 | 160.2 | 92 | 463.6 | 64.8 | 6.3 | 7 | Comparative Example |
| B2 | 136.4 | 1036 | 461.3 | 83.9 | 6.3 | 10 | Example |
| B3 | 5.30 | 586 | 304.9 | 30.6 | 7.0 | 9 | Example |
| B4 | 4.75 | 1386 | 442.6 | 25.9 | 4.6 | 1 | Comparative Example |
| B5 | 17.3 | 3247 | 48.0 | 37.8 | 5.3 | 7 | Comparative Example |
| B6 | 109.7 | 2710 | 49.9 | 19.7 | 2.6 | 10 | Example |
| B7 | 72.3 | 300 | 359.0 | 3.5 | 8.4 | 8 | Example |
| B8 | 146.1 | 290 | 137.7 | 65.0 | 4.6 | 1 | Comparative Example |
| B9 | 84.9 | 2863 | 512.7 | 40.1 | 0.8 | 7 | Comparative Example |
| B10 | 27.6 | 1919 | 473.6 | 44.7 | 0.4 | 8 | Example |
| B11 | 148.7 | 809 | 1.00 | 60.5 | 7.4 | 10 | Example |
| B12 | 99.3 | 1612 | 0.98 | 3.7 | 7.2 | 1 | Comparative Example |
| B13 | 6.0 | 1760 | 180.9 | 100.7 | 7.9 | 7 | Comparative Example |
| B14 | 33.2 | 320 | 79.8 | 90.8 | 3.4 | 10 | Example |
| B15 | 42.8 | 2770 | 356.9 | 0.10 | 5.7 | 10 | Example |
| B16 | 101.4 | 1452 | 41.3 | 0.098 | 3.4 | 1 | Comparative Example |
| B17 | 40.2 | 1613 | 434.8 | 87.7 | 10.5 | 2 | Comparative Example |
| B18 | 112.9 | 2067 | 310.8 | 50.6 | 9.0 | 8 | Example |
| B19 | 121.4 | 1580 | 368.0 | 18.9 | 0.33 | 10 | Example |
| B20 | 74.7 | 2675 | 179.1 | 69.5 | 0.28 | 3 | Comparative Example |

Next, under the conditions shown in Table 5 below, samples of each level were produced. The amount of each component of the samples was measured in the same manner as in the case of the above Tables 2 and 4 and the sulfide stain resistance was evaluated with the naked eye by the same method as in the case of the above Tables 2 and 4. The obtained results are shown in Table 6 below.

TABLE 5

| Level | Reflow treatment temperature [° C.] | Reflow treatment time [sec] | Zr ion [ppm] | Fluoride ion [ppm] | Phosphate ion [ppm] | Nitrate ion [ppm] | Electrolysis treatment temperature [° C.] | Current density [A/dm$^2$] | Electrolysis treatment time [sec] | Amount of tin oxide [mC/cm$^2$] | Evaluation result of sulfide stain resistance | Remarks |
|---|---|---|---|---|---|---|---|---|---|---|---|---|
| C1-1 | 219 | 12.8 | 4909 | 3497 | 2007 | 6217 | 44.3 | 13.7 | 40.4 | 1.7 | 8 | Example |
| C1-2 | 219 | 13.2 | 4909 | 3497 | 2007 | 6217 | 44.3 | 13.7 | 40.4 | 2.8 | 8 | Example |
| C1-3 | 219 | 14.7 | 4909 | 3497 | 2007 | 6217 | 44.3 | 13.7 | 40.4 | 4.7 | 9 | Example |
| C1-4 | 219 | 15.2 | 4909 | 3497 | 2007 | 6217 | 44.3 | 13.7 | 40.4 | 5.9 | 10 | Example |
| C1-5 | 219 | 16.3 | 4909 | 3497 | 2007 | 6217 | 44.3 | 13.7 | 40.4 | 8.2 | 10 | Example |
| C2-1 | 201 | 1.1 | 496 | 5342 | 1150 | 23764 | 85.7 | 80.3 | 77.1 | 0.9 | 9 | Example |
| C2-2 | 201 | 4.5 | 496 | 5342 | 1150 | 23764 | 85.7 | 80.3 | 77.1 | 1.9 | 8 | Example |
| C2-3 | 201 | 10.3 | 496 | 5342 | 1150 | 23764 | 85.7 | 80.3 | 77.1 | 6.2 | 10 | Example |
| C2-4 | 201 | 11.7 | 496 | 5342 | 1150 | 23764 | 85.7 | 80.3 | 77.1 | 7.1 | 10 | Example |
| C2-5 | 201 | 19.8 | 496 | 5342 | 1150 | 23764 | 85.7 | 80.3 | 77.1 | 9.7 | 10 | Example |

TABLE 6

| Level | Amount of metal Ni [mg/m$^2$] | Amount of metal Sn [mg/m$^2$] | Amount of metal Zr [mg/m$^2$] | P [mg/m$^2$] | Amount of tin oxide [mC/cm$^2$] | Evaluation result of sulfide stain resistance | Remarks |
|---|---|---|---|---|---|---|---|
| C1-1 | 131.4 | 971 | 259.7 | 39.4 | 1.7 | 8 | Example |
| C1-2 | 131.4 | 971 | 259.7 | 39.4 | 2.8 | 8 | Example |
| C1-3 | 131.4 | 971 | 259.7 | 39.4 | 4.7 | 9 | Example |
| C1-4 | 131.4 | 971 | 259.7 | 39.4 | 5.9 | 10 | Example |
| C1-5 | 131.4 | 971 | 259.7 | 39.4 | 8.2 | 10 | Example |
| C2-1 | 108.5 | 1747 | 200.5 | 72.1 | 0.9 | 9 | Example |
| C2-2 | 108.5 | 1747 | 200.5 | 72.1 | 1.9 | 8 | Example |
| C2-3 | 108.5 | 1747 | 200.5 | 72.1 | 6.2 | 10 | Example |
| C2-4 | 108.5 | 1747 | 200.5 | 72.1 | 7.1 | 10 | Example |
| C2-5 | 108.5 | 1747 | 200.5 | 72.1 | 9.7 | 10 | Example |

In each test example shown in Tables 1 and 2, tests were performed while mainly focusing on each condition at the time of producing the steel sheets for containers and in each test example shown in Tables 3 and 4, tests were performed while mainly focusing on the properties of the produced steel sheets for containers. In each test example shown in Tables 5 and 6, tests were performed while changing the amount of tin oxide by changing a reflow treatment time.

As can be clearly seen from the above Tables 1 to 6, it was found that the steel sheets of the present invention exhibited sulfide stain resistance through the above-described evaluation test of sulfide stain resistance.

Next, under the conditions shown in Table 7 below, samples of each level were produced. The coated amount of tin oxide was measured in the same manner as in the case of the above Tables 2, 4, and 6. The sulfide stain resistance was evaluated by the evaluation method with the naked eye shown in the above Tables 2, 4, and 6 and the evaluation method based on YI. The obtained results are shown in Table 8 and FIGS. 5A and 5B.

TABLE 7

| Level | Reflow treatment temperature [° C.] | Reflow treatment time [sec] | Zr ion [ppm] | Fluoride ion [ppm] | Phosphate ion [ppm] | Nitrate ion [ppm] | Electrolysis treatment temperature [° C.] | Current density [A/dm$^2$] | Electrolysis treatment time [sec] | Remarks |
|---|---|---|---|---|---|---|---|---|---|---|
| D1 | 346 | 8.4 | 4517 | 16440 | 564 | 29514 | 23 | 104 | 104 | Comparative Example |
| D2 | 241 | 12.7 | 15441 | 3554 | 2110 | 10234 | 45 | 52 | 178 | Comparative Example |
| D3 | 255 | 0.1 | 1237 | 7845 | 799 | 23 | 10 | 41 | 101 | Comparative Example |
| D4 | 289 | 5.8 | 3617 | 1040 | 1642 | 10741 | 36 | 55 | 74 | Example |
| D5 | 220 | 2.6 | 9103 | 2125 | 1304 | 4512 | 55 | 90 | 45 | Example |
| D6 | 237 | 7.3 | 4017 | 6667 | 784 | 2323 | 20 | 10 | 55 | Example |
| D7 | 291 | 9.4 | 6461 | 8951 | 99 | 2010 | 37 | 74 | 64 | Example |
| D8 | 258 | 15.3 | 8932 | 2314 | 461 | 7896 | 19 | 16 | 31 | Example |
| D9 | 204 | 16.8 | 7745 | 5852 | 1009 | 10098 | 48 | 27 | 0.9 | Example |
| D10 | 265 | 12.1 | 5641 | 2223 | 2415 | 24101 | 51 | 31 | 37 | Example |

TABLE 8

| Level | Amount of metal Ni [mg/m$^2$] | Amount of metal Sn [mg/m$^2$] | Amount of metal Zr [mg/m$^2$] | Amount of P [mg/m$^2$] | Amount of tin oxide [mC/cm$^2$] | Yellowness index (YI) | Evaluation point for sulfide stain resistance | Remarks |
|---|---|---|---|---|---|---|---|---|
| D1 | 190 | 519 | 45 | 41 | 0.1 | 44.03 | 1 | Comparative Example |
| D2 | 21 | 1204 | 1023 | 77 | 0.15 | 40.69 | 2 | Comparative Example |
| D3 | 52 | 4109 | 13 | 90 | 0.2 | 36.78 | 4 | Comparative Example |
| D4 | 45 | 1098 | 417 | 25 | 0.3 | 23.92 | 8 | Example |
| D5 | 11 | 2140 | 336 | 31 | 0.7 | 21.2 | 9 | Example |
| D6 | 31 | 2311 | 301 | 60 | 1.5 | 21.4 | 9 | Example |
| D7 | 70 | 901 | 461 | 69 | 3.2 | 19.2 | 10 | Example |
| D8 | 61 | 743 | 10 | 84 | 5.1 | 18.3 | 10 | Example |
| D9 | 39 | 405 | 67 | 11 | 7.8 | 19.3 | 10 | Example |
| D10 | 47 | 1210 | 84 | 47 | 9.2 | 18.7 | 10 | Example |

Figure 5A:
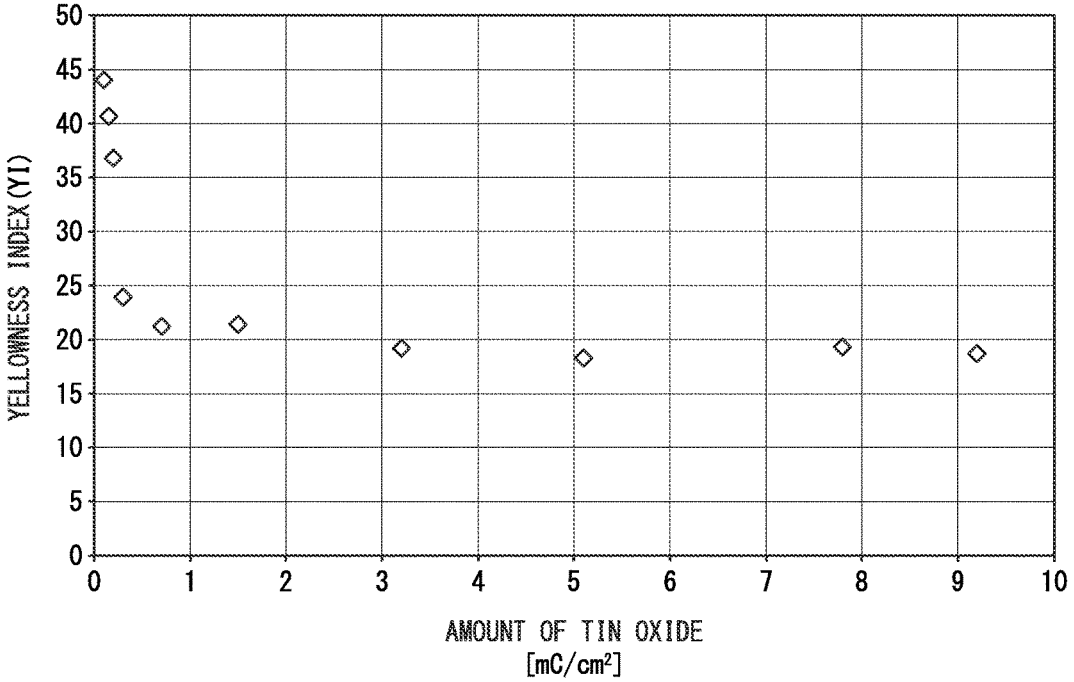
FIG. 5A is a diagram plotting the relationship between the amount of tin oxide and a yellowness index (YI).
Figure 5B:
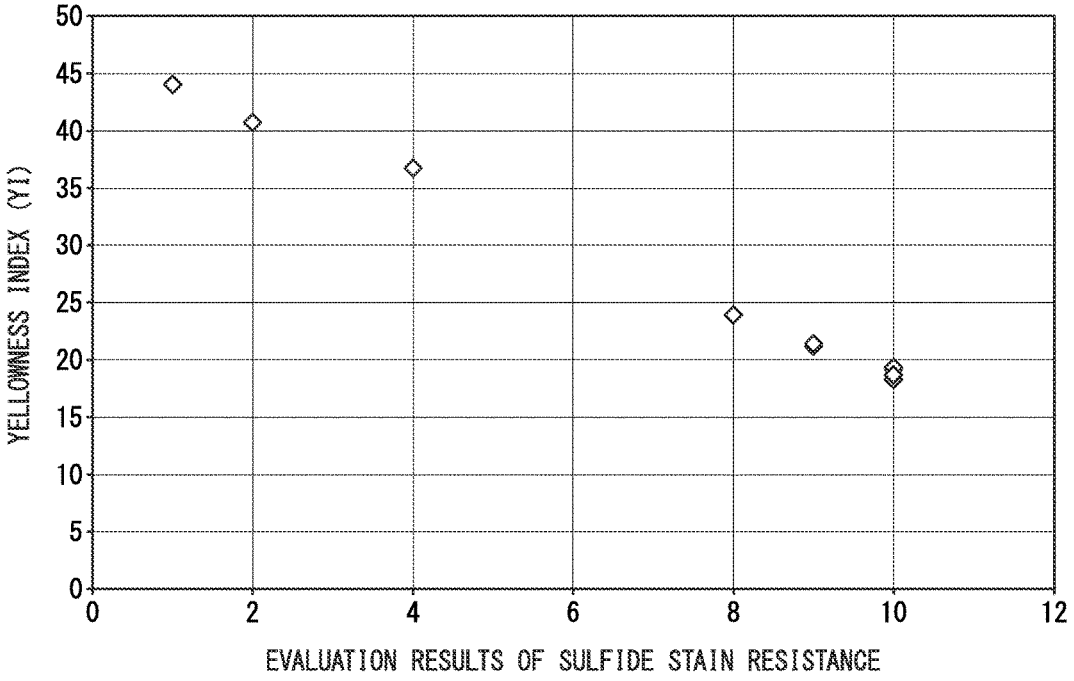
FIG. 5B is a diagram plotting the relationship between the evaluation results of sulfide stain resistance and a yellowness index (YI).

As can be clearly seen from the above Table 8 and FIGS. 5A and 5B, it was found that the numerical values of YI corresponded well to sensory evaluation results with the naked eye and YI could be used as an index for quantitatively indicating a surface color change due to sulfide stain.

While the preferable embodiment of the present invention has been described in detail with reference to the drawings, the present invention is not limited to the present embodiment. It should be noted by those skilled in the art to which the present invention belongs that various changes and modification examples can be made in the scope of the technical idea described in the appended claims, and these examples naturally belong to the technical range of the present invention.

INDUSTRIAL APPLICABILITY

According to the present invention, it is possible to achieve sulfide stain resistance and cost reduction using a chemical treatment film by forming an oxide layer between the chemical treatment layer and a Sn coated layer.

BRIEF DESCRIPTION OF THE REFERENCE SYMBOLS

10: STEEL SHEET FOR CONTAINERS
101: STEEL SHEET
103: UNDERLYING Ni LAYER
105: Sn COATED LAYER
107: OXIDE LAYER
109: CHEMICAL TREATMENT LAYER

The invention claimed is:

1. A steel sheet for containers, comprising:

a steel sheet;

an underlying Ni layer formed by performing a Ni coating or a Fe—Ni alloy coating containing Ni in an amount of 5 mg/m$^2$ to 150 mg/m$^2$ in terms of an amount of metal Ni on at least one surface of the steel sheet;

a Sn coated layer fondled by performing a Sn coating containing Sn in an amount of 300 mg/m$^2$ to 3,000 mg/m$^2$ in terms of an amount of metal Sn on the underlying Ni layer and including an island-shaped Sn formed by alloying the Sn coating and at least a part of the underlying Ni layer by a reflow treatment;

an oxide layer which is formed on the Sn coated layer by the reflow treatment and which consists of tin oxide; and a chemical treatment layer which is formed on the oxide layer and which consists of Zr compounds containing Zr in an amount of 1 mg/m$^2$ to 500 mg/m$^2$ in terms of an amount of metal Zr and phosphoric acid compounds in an amount of 0.1 mg/m$^2$ to 100 mg/m$^2$ in terms of an amount of P, wherein the oxide layer consists of tin oxide in such an amount that an amount of electricity required for reduction of the oxide layer is 5.5 mC/cm$^2$ to 10 mC/cm$^2$.

2. The steel sheet for containers according to claim 1, wherein after a coating is applied to the surface of the steel sheet for containers and the steel sheet is baked to form a lacquer, the steel sheet for containers in which the lacquer is formed is placed and fixed onto an opening of a heat-resistant bottle in which a 0.6% by mass L-cysteine solution, which is boiled for 1 hour, is stored, the heat-resistant bottle is capped with a lid, a heat treatment is performed at 110° C. for 30 minutes in a state of the lid being upside down, and then when an appearance of a contact portion of the steel sheet for containers in which the lacquer is formed with the heat-resistant bottle is observed, a stain does not occur in 50% or more of an area of the contact portion.

3. A method for producing the steel sheet for containers according to claim 1, the method comprising:

forming an underlying Ni layer containing Ni in an amount of 5 mg/m$^2$ to 150 mg/m$^2$ in terms of an amount of metal Ni by performing a Ni coating or a Fe—Ni alloy coating on at least one surface of a steel sheet;

performing a Sn coating containing Sn in an amount of 300 mg/m$^2$ to 3,000 mg/m$^2$ in terms of an amount of metal Sn on the underlying Ni layer;

forming an oxide layer containing tin oxide by oxidizing a surface of a Sn coated layer, while forming the Sn coated layer including an island-shaped Sn formed by alloying the Sn coating and at least a part of the underlying Ni layer by performing a reflow treatment at a temperature of 200° C. or higher and 300° C. or lower for 0.2 seconds to 20 seconds; and forming a chemical treatment layer on the oxide layer by performing an electrolysis treatment at a current density of 1.0 A/dm$^2$ or more and 100 A/dm$^2$ or less for an electrolysis treatment time of 0.2 seconds or longer and 150 seconds or shorter in a chemical treatment solution including 10 ppm or more and 10,000 ppm or less of Zr ions, 10 ppm or more and 10,000 ppm or less of fluoride ions, 10 ppm or more and 3,000 ppm or less of phosphate ions, and 100 ppm or more and 30,000 ppm or less of nitrate ions and/or sulfate ions and having a temperature of 5° C. or higher and lower than 90° C.

* * * * *